US008474264B2

(12) United States Patent
McCutchen

(10) Patent No.: US 8,474,264 B2
(45) Date of Patent: Jul. 2, 2013

(54) RADIAL COUNTERFLOW STEAM STRIPPER

(75) Inventor: Wilmot H. McCutchen, Orinda, CA (US)

(73) Assignee: McCutchen Co., Portland, OR (US)

( * ) Notice: Subject to any disclaimer, the term of this patent is extended or adjusted under 35 U.S.C. 154(b) by 175 days.

(21) Appl. No.: 13/162,401

(22) Filed: Jun. 16, 2011

(65) Prior Publication Data

US 2011/0265480 A1 Nov. 3, 2011

Related U.S. Application Data

(63) Continuation of application No. 12/345,324, filed on Dec. 29, 2008, now Pat. No. 7,987,677.

(60) Provisional application No. 61/041,110, filed on Mar. 31, 2008.

(51) Int. Cl.

| | |
|---|---|
| ***F01K 13/00*** | (2006.01) |
| ***F01K 23/06*** | (2006.01) |
| ***B01D 53/24*** | (2006.01) |
| ***B01D 59/20*** | (2006.01) |
| ***B01D 45/12*** | (2006.01) |

(52) U.S. Cl.
USPC ..... 60/670; 60/645; 95/35; 95/270

(58) Field of Classification Search
USPC ..... 60/645–681, 685–697; 55/406–409, 55/DIG. 23; 95/34, 35, 269–272
See application file for complete search history.

(56) References Cited

U.S. PATENT DOCUMENTS

| | | | | |
|---|---|---|---|---|
| 1,952,281 | A | 3/1934 | Ranque | |
| 2,422,882 | A * | 6/1947 | Bramley | 494/13 |
| 3,566,610 | A | 3/1971 | Fiore | |
| 3,603,062 | A | 9/1971 | Robbins et al. | |
| 3,731,800 | A * | 5/1973 | Timson | 209/210 |

(Continued)

FOREIGN PATENT DOCUMENTS

| | | |
|---|---|---|
| EP | 0319699 | 6/1989 |

OTHER PUBLICATIONS

Bergles, A. (May 2001). "The Implications and Challenges of Enhanced Heat Transfer for the Chemical Process Industries". Institution of Chemical Engineers, Trans IChemE, vol. 79, Part A, pp. 437-444.

(Continued)

*Primary Examiner* — Kenneth Bomberg
*Assistant Examiner* — Christopher Jetton
(74) *Attorney, Agent, or Firm* — Marger Johnson & McCollom P.C.

(57) ABSTRACT

Turbine exhaust steam, axially fed between counter-rotating radial flow disk turbines, separates into: (1) a radially inward flow of low enthalpy dry steam, and (2) a radially outward flow of high enthalpy steam, noncondensibles, and condensate. The radially inward flow goes to a conventional condenser. The radially outward flow loses enthalpy turning the disk turbines as it passes in the boundary layers against the disks, thus becoming low enthalpy dry steam, and the counter-rotation of the disks by impinging mass flow of condensate, high enthalpy steam, and noncondensibles sustains a cascade of dynamic vortex tubes in the shear layer between the boundary layers. The low enthalpy dry steam resulting from work being done flows into the condenser through the vortex cores of fractal turbulence. Condensate exits the periphery of the workspace, ready to be pumped back into the Rankine cycle.

6 Claims, 9 Drawing Sheets

U.S. PATENT DOCUMENTS

| | | | | |
|---|---|---|---|---|
| 3,902,876 | A | 9/1975 | Moen et al. | |
| 3,922,871 | A | 12/1975 | Bolesta | |
| 3,982,378 | A | 9/1976 | Sohre | |
| 3,999,400 | A | 12/1976 | Gray | |
| 4,037,414 | A | 7/1977 | Nicodemus | |
| 4,333,017 | A | 6/1982 | O'Connell | |
| 4,362,020 | A | 12/1982 | Meacher et al. | |
| 4,479,354 | A | 10/1984 | Cosby | |
| 4,582,513 | A * | 4/1986 | van der Burgt | 95/270 |
| 5,137,681 | A | 8/1992 | Dougherty | |
| 5,275,006 | A | 1/1994 | McCutchen | |
| 5,441,102 | A | 8/1995 | Burward-Hoy | |
| 5,476,537 | A | 12/1995 | Yi et al. | |
| 5,534,118 | A | 7/1996 | McCutchen | |
| 5,611,214 | A | 3/1997 | Wegeng et al. | |
| 5,688,377 | A | 11/1997 | McCutchen | |
| 6,145,296 | A | 11/2000 | Rakhmailov | |
| 6,208,512 | B1 | 3/2001 | Goldowsky et al. | |
| 6,484,503 | B1 | 11/2002 | Raz | |
| 6,494,935 | B2 | 12/2002 | Cho et al. | |
| 6,516,617 | B1 | 2/2003 | Schwieger | |
| 6,550,531 | B1 | 4/2003 | Searls et al. | |
| 6,751,940 | B1 | 6/2004 | Paul | |
| 6,856,037 | B2 | 2/2005 | Yazawa et al. | |
| 6,894,899 | B2 | 5/2005 | Wu et al. | |
| 6,943,461 | B2 | 9/2005 | Kaploun | |
| 6,945,314 | B2 | 9/2005 | Farrow et al. | |
| 7,002,800 | B2 | 2/2006 | Elias et al. | |
| 7,035,104 | B2 | 4/2006 | Meyer | |
| 7,055,581 | B1 | 6/2006 | Roy | |
| 7,062,900 | B1 | 6/2006 | Brun | |
| 7,121,906 | B2 | 10/2006 | Sundel | |
| 7,169,305 | B2 | 1/2007 | Gomez | |
| 7,174,715 | B2 | 2/2007 | Armitage et al. | |
| 7,263,836 | B2 | 9/2007 | Gunawardana et al. | |
| 7,310,232 | B2 | 12/2007 | Touzov | |
| 7,352,580 | B2 | 4/2008 | Tsai | |
| 7,757,866 | B2 | 7/2010 | McCutchen | |
| 2004/0261417 | A1 | 12/2004 | Yamashita et al. | |
| 2006/0010871 | A1 | 1/2006 | Frechette et al. | |
| 2009/0013867 | A1 | 1/2009 | McCutchen | |
| 2009/0045150 | A1 | 2/2009 | McCutchen | |

OTHER PUBLICATIONS

Chen, J. et al. (May 2007). "Fractal-like tree networks increasing the permeability". Physical Review E 75, 056301, pp. 056301-1-056301-8.

Feeley, T. et al. (Jul. 2005). "Department of Energy/Office of Fossil Energy's Power Plant Water Management R&D Program". DOE/FE's Power Plant Water Management R&D Program Summary, pp. 1-14.

Gao, C. (2005). "Experimental Study on the Ranque-Hilsch Vortex Tube". CIP-Data Library Technische Universiteit Eindhoven, pp. 1-148.

Hellyar, K. (1979). "Gas Liquefaction Using a Ranque-Hilsch Vortex Teube: Design Criteria and Bibliography". Massachusetts Institute of Technology, pp. 1-68.

Promvonge, P. et al. (2005). "Investigation on the Vortex Thermal Separation in a Vortex Tube Refrigerator". ScienceAsia 31, pp. 215-223.

Shtern, V. et al. (1999). "Collapse, Symmetry Breaking, and Hysteresis in Swirling Flows". Annu. Rev. Fluid Mech. 31, pp. 537-566.

UOP LLC (2003). "FCC Vortex Separation Technology: The VDS Design and VSS Design". Process Technology and Equipment (4 pages).

Zandergen, P. et al. (1987). "Von Karman Swirling Flows". Ann. Rev. Fluid Mech. 19, pp. 465-491.

U.S. Appl. No. 12/004,308, filed Dec. 20, 2007 entitled "Rotary Annular Crossflow Filter, Degasser, and Sludge Thickener."

U.S. Appl. No. 12/167,771, filed Jul. 3, 2008 entitled "Radial Counterflow Shear Electrolysis."

U.S. Appl. No. 12/178,441, filed Jul. 23, 2008 entitled "Vapor Vortex Heat Sink."

U.S. Appl. No. 12/234,541, filed Sep. 19, 2008 entitled "Electrohydraulic and Shear Cavitation Radial Counterlow Liquid Processor."

U.S. Appl. No. 12/368,236, filed Feb. 9, 2009 entitled "Shear Reactor for Vortex Synthesis of Nanotubes."

* cited by examiner the vortex-wall interaction

RADIAL COUNTERFLOW STEAM STRIPPER

APPLICATION HISTORY

This application is a continuation of U.S. patent application Ser. No. 12/345,324 titled "RADIALCOUNTERFLOW STEAM STRIPPER", filed Dec. 29, 2008, now allowed, which application claims priority to U.S. Provisional Patent Application No. 61/041,110, filed Mar. 31, 2008, all of which are incorporated herein by reference in their entirety for all intents and purposes.

FIELD OF THE INVENTION

This invention applies to exhaust steam handling means, to means for evaporative cooling, to vacuum distillation, and to means for energy and water conservation at power plants.

BACKGROUND OF THE INVENTION

Water and Energy Waste at Thermal Power Plants

The thermal efficiency of a modern steam power plant is only ~35%. Most of the energy in its fuel is wasted. Inefficiency is principally due to heat rejection in the cooling tower, where waste heat from the steam turbine exhaust is dumped into the atmosphere as latent heat in vapor of cooling water.

The vapor out of the cooling tower is wasted water as well as wasted energy. Fresh water used for thermal power plant cooling water is becoming a precious commodity, forcing a choice between water for power and water for people. The amount of water wasted by conventional thermal power plants is enormous. The United States Geological Survey (USGS) estimates that thermoelectric power generation requires $3.6\times10^{10}$ cubic meters ($m^3$), or 136 billion gallons, of fresh water per day. In the year 2000, that was 39% of freshwater withdrawals in the United States, slightly less than agricultural irrigation (40%), and much more than other industrial and residential use.

A need exists for improved means for condensing exhaust steam, avoiding the water and energy waste of cooling towers and conventional steam condensing. An object of the present invention is to fill that need.

Turbine Exhaust Steam

Power plant turbine exhaust steam is wet, i.e. it has a high weight percentage of condensate. Turbine blade erosion concerns place a lower limit on quality (weight percent of vapor) of 0.88, with most turbines operating in the 0.90-0.95 range. Exhaust steam still has high energy content, or enthalpy (kJ/kg), even after doing work in the turbine, but its energy is principally in latent heat of condensation ($h_{fg}$). The latent heat must be extracted so that the water can condense and be pumped back into the boiler to be re-used in the Rankine cycle.

Mass flow through a steam turbine is pushed by the high pressure of the boiler and simultaneously pulled by the low pressure of a steam condenser. Condensation of vapor in the steam condenser creates a vacuum (typically 0.03-0.4 bar) which pulls more steam through the turbine.

The conventional steam condenser (surface condenser) comprises a shell and tubes disposed within the shell. The tubes are part of a cooling water circuit. Turbine exhaust steam is injected into the shell, and cooling water circulating through the tubes bears off the waste heat to the cooling tower. The condensate drips into a hotwell and is pumped back into the boiler. The cooling water is sprayed into a cooling tower, where evaporative cooling rejects the turbine exhaust waste heat into the atmosphere. Vapor out of the cooling tower is wasted water. The water volume in the cooling water circuit must be replenished by make-up water, which must be carefully pre-treated to prevent scaling and biofouling within the tubes.

Re-use of the cooling water and its continuous evaporation concentrates the dissolved solids, so periodically some blowdown is discharged to purge the system. Evaporation builds up a high concentration of limestone (calcium carbonate, $CaCO_3$), sulfates, and other scale-forming compounds in the cooling water. Scale is a tough and insulating crust which is precipitated by heat on the interior walls of the tubes. The blow-down has a high percentage of total dissolved solids and is a water pollution problem as well as a waste of a precious resource.

A steam ejector communicating with the shell purges any noncondensible gases and also helps to maintain a very low pressure in the shell. Low pressure in the condenser is key to optimal Rankine cycle efficiency.

Cooling Towers

The waste heat absorbed by the cooling water of the shell and tube surface condenser could be discharged immediately by dumping the cooling water into the environment (the once-through process), but this option is not favored because thermal pollution of the environment is usually not acceptable. Air cooling is another option, but for large power plants it is not satisfactory because of the low heat flux between fins and ambient air, even when the air is blown. When the heat load is large and the ambient air is hot, such as on a hot summer day when many air conditioners are running, air cooling may fail.

The preferred method for reliable heat rejection is to extract the heat load by evaporative cooling in order that the cooling water can be recycled through the tubes. The conventional evaporative cooling method involves a cooling tower. Within the cooling tower, an updraft of air meets a spray of hot cooling water, and evaporation cools the spray. Typically 3-6% of cooling water sprayed in is lost by evaporation in the cooling tower, a large waste of water as well as energy. In a typical 700 MW coal-fired power plant, having a circulation rate of 71,600 $m^3$/hr, the water waste is 3,600 cubic meters an hour.

Nuclear and gas plants also waste water in heat rejection from their steam turbine exhaust, no less than coal plants. A major siting constraint on nuclear plants is the scarcity of fresh water. Of course, seawater or alkaline water won't work for a cooling water circuit because it contains scale-forming dissolved solids which precipitate at high temperatures and would quickly clog the tubes.

Petroleum refineries have very large cooling water systems. A typical large refinery processing 40,000 metric tons of crude oil per day (~300,000 barrels per day) circulates about 80,000 cubic meters of water per hour through its cooling tower system, evaporating and wasting a prodigious amount of precious fresh water. Dumping vapor in the atmosphere is not a sustainable practice, and a need exists for an alternative method for heat rejection which does not waste water.

Another reason, besides water waste, to eliminate cooling towers is the danger they pose to public health. The warm, moist environment in a cooling tower provides a favorable habitat for the Legionella bacteria that cause Legionellosis, a type of pneumonia commonly known as Legionnaire's disease. Studies have shown that 40 to 60% of cooling towers are infected with Legionella. Entrained infected mist droplets in the drift out of the stack provide transportation for these bacteria to contact with humans kilometers away. Each year in the United States, 8,000-18,000 people are infected. Therefore biocideal treatment is necessary, and there is strict regulatory scrutiny.

Infected steam billowing from cooling towers is a visible threat to the health of the community. Public acceptance of the presence of power plants is an important consideration in siting. Cooling towers, whose profile is associated with the nuclear disaster at Three Mile Island, and which emit huge volumes of what looks like smoke, are not good for public relations. They are a prominent and objectionable feature of any power plant. Now that fresh water has become a scarce resource, coal, gas, and nuclear power plants have a need for an alternative to cooling towers, and the present invention is intended to fill that need.

The Ranque-Hilsch Vortex Tube

The vortex tube is an axial counterflow device having no moving parts, wherein feed pressure drives thermal separation into a cold stream and a hot stream. See Ranque, U.S. Pat. No. 1,952,281 (1934). Length of a vortex tube is typically between 30-50 tube diameters. How thermal separation occurs in a vortex tube has not been settled, and interesting speculation abounds. See Chengming Gao, *Experimental Study on the Ranque-Hilsch Vortex Tube* (Eindhoven 2005) http://alexandria.tue.nl/extra2/200513271.pdf.

In operation, a tangential feed nozzle at a cold end of the vortex tube jets in a pressurized gas feed which swirls along the tube to a conical impedance partially blocking the opposite end, the hot end. The conical impedance is a valve pointing toward the cold end, and there is a passage around the conical impedance where the hot stream exits at a higher temperature and lower pressure than the feed. A cold stream rebounds from the conical impedance in an axial jet inside the feed vortex and exits the cold end at a lower temperature and lower pressure than the feed. Thus a hot stream and a cold stream are separated from a feed stream, both at lower pressure. Feed pressure drives thermal separation in a very simple and easily scalable device. Commercial applications of the vortex tube include spot cooling for welding and machining operations.

Cascading of vortex tubes has the problem of reduced feed pressure at each successive stage of the cascade, with consequent loss of separation, unless there is some boosting of feed pressure between stages. The present invention provides means for inter-stage boosting in multiscale cascades of vortex tubes.

Some investigation of application of the vortex tube to steam condensers has been done. Schwieger U.S. Pat. No. 6,516,617 (2003) discloses a system which uses a cascade of static vortex tubes to separate exhaust steam, each stage of the cascade producing a hot stream and a cold stream. In the Schwieger system, the cold stream carries off condensate. At each stage, condensate in the cold stream is pressurized by a pump and then is heated by the hot stream, becoming feed for a secondary steam turbine. However, in field testing of natural gas separation, condensate was found in the hot stream, and not the cold stream. K. Hellyar "Gas Liquefaction using a Ranque-Hilsch Vortex Tube: Design Criteria and Bibliography" (MIT 1979) http://dspace.mit.edu/bitstream/handle/1721.1/16105/07771761.pdf at p. 16. This experimental result makes sense because condensate is much denser than the gas, so it will be centrifugated out in the vortex and will be extracted from the vortex tube along with the hot stream. The present invention, in accord with this experimental result, teaches away from the cold stream advection of condensate disclosed in Schweiger.

Nicodemus, U.S. Pat. No. 4,037,414 (1977) also uses a vortex tube in a Rankine cycle device wherein the hot stream powers an injector upstream of the boiler, which receives the cold stream and mixes it with the hot stream. Cosby, U.S. Pat. No. 4,479,354 (1984) teaches a vortex tube for scavenging energy in the exhaust steam in order to improve thermal efficiency of a turbine. See also Promvonge, et al., *Science Asia* 31: 215-223 (2005).

SUMMARY OF THE INVENTION

Counter-rotating spaced-apart radial flow disk turbines, fed at their common axis of rotation by turbine exhaust steam, produce a multiscale cascade of dynamic vortex tubes in the shear layer between them. In the vortex tube cascade, which is fractal turbulence, two streams are continuously separated out of the feed: (1) a stream of low enthalpy saturated vapor, which goes to a steam condenser, and (2) a stream comprising high enthalpy saturated vapor, condensate, and noncondensible gases. The high enthalpy vapor loses enthalpy doing useful work and condenses apart from the steam condenser. The steam condenser only has to extract the latent heat from a reduced mass flow of cool vapor, and is not burdened by noncondensibles and condensate. The cooling water is not burdened by the energy in the high enthalpy steam.

The cascade of dynamic vortex tubes link in a vascular network for axially extracting the low enthalpy saturated vapor (the first stream). The low enthalpy vapor flows radially inward from the fine-scale vortices into the larger scale vortices and eventually into the steam condenser, drawn along low pressure gradients established by the shear of the disk turbines and the suction of the condenser.

The second stream (high enthalpy vapor, noncondensibles, and condensate) pushes the disk turbines as it flows radially outward to the periphery of the space between them, where it emerges as condensate and noncondensibles. The work done by the high enthalpy vapor reduces its enthalpy, and the low enthalpy steam resulting from this work falls into the vortex cores and is axially extracted.

The conventional approach is to dump both the high energy molecules and the low energy molecules into the condenser, along with the condensate and noncondensibles. The present invention strips out the low energy molecules and passes only those to the condenser, leaving the high energy molecules, condensate, and noncondensibles out of the condenser and doing useful work sustaining a radial counterflow forcing regime and even turning a generator.

The steam stripper works on the turbine exhaust energy which otherwise would be totally wasted up the cooling tower. A generator may be run by connecting a peripheral drive wheel between the disks, thereby increasing the efficiency of the power plant. By pushing the disks, the high enthalpy vapor loses enthalpy and condenses, thereby reducing the load on the condenser and allowing for a more intelligent system of cooling water cooling.

The present invention also offers means for recycling the cooling water without cooling towers. Thermal separation, to chill the cooling water and reject the waste heat from the condenser, occurs in fractal turbulence driven by a radial counterflow forcing regime. The tree-like radial arrays of low pressure gradients between axially-fed counter-rotating impellers provide a dynamic vascular network for extracting the waste heat from the cooling water in high turbulence and transporting the vapor to a condenser, where pure water is recovered. Water is not wasted by dumping vapor into the atmosphere.

In a shear layer between the disks is an array of radial vortex trees which are fractal turbulence. Cores of fine-scale vortices communicate with the cores of larger-scale radial vortices, and so on to the axial exhaust port at the axis of rotation of the disks. In each vortex, centrifugal separation of cool water from hot water occurs due to the density difference. The cool fraction goes to a boundary layer against the disks, and the warm fraction remains in the shear layer. Momentum transfer from the disks goes preferentially into the cool water, which is advected radially outward to collection and recirculation. The disks are driven by peripheral drive wheels turning between them.

A large surface area for evaporative cooling is presented by the vascular network of vortex trees in the shear layer between the counter-rotating centrifugal impellers. The warm fraction of the cooling water, which because it is less dense collects at the vortex cores, is squeezed radially inward to the impeller axis by the vortex-wall interaction and then is opened into larger and larger vortices having vapor cores communicating with the condenser. The low pressure of the condenser causes the warm fractions to evaporate and reject their latent heat in vapor. A continuous stream of cool, low enthalpy vapor, bearing off the cooling water heat load as latent heat of evaporation, flows radially inward through the vortex cores to the disk axis of rotation and from there into the steam condenser where it is recovered as distilled water.

SUMMARY DESCRIPTION OF THE DRAWING FIGURES

FIG. 1 shows a Ranque-Hilsch vortex tube according to prior art.

FIG. 2*a* shows the velocity profile about the axis of rotation of a vortex in a vortex tube according to prior art.

FIG. 2*b* shows the velocity profile parallel to the axis of rotation of a vortex in a vortex tube according to prior art.

FIG. 2*c* shows a cross-section of a steam vortex in a dynamic vortex tube according to the present invention, and the velocity profile about the axis of rotation.

FIG. 2*d* shows the radial counterflow velocity profile parallel to the axis of rotation of a dynamic vortex tube according to the present invention.

DRAWING REFERENCE NUMERALS

1—vortex tube
2—cold end
3—hot end
4—feed port
5—conical impedance
6—nozzle
7—pump
8—boiler
9—turbine
10—condenser
11—bottom radial flow disk turbine
12—top radial flow disk turbine
13—workspace between counter-rotating radial flow disk turbines 11,12
14—axial feed conduit
15—axial feed port
16—axial exhaust port
17—axial exhaust conduit
18—steam condenser for low enthalpy saturated vapor
19—runners
20—baffle
21—periphery
22—peripheral drive wheel and associated drive spindle and generator/motor
23—annular shrouding wall
24—condensate drain
25—noncondensibles vent

DETAILED DESCRIPTION OF THE INVENTION

Figure 1:
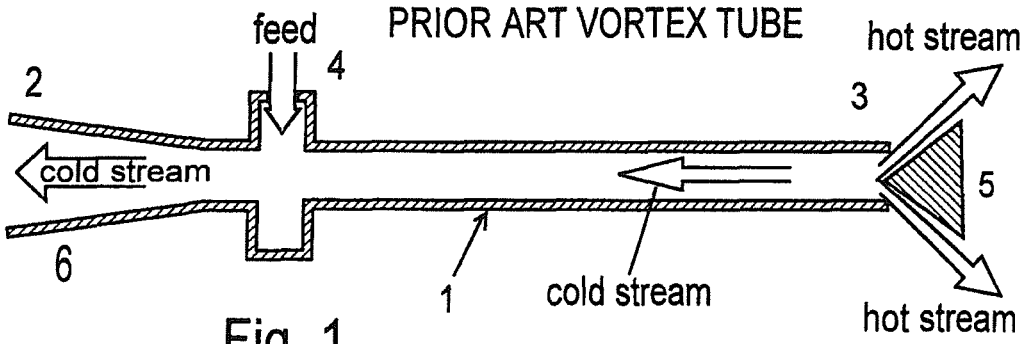

FIG. 1 shows a Ranque-Hilsch vortex tube according to prior art. See Ranque U.S. Pat. No. 1,952,281 (1934), Chengming Gao, *Experimental Study on the Ranque-Hilsch Vortex Tube* (Eindhoven 2005) alexandria.tue.nl/extra2/200513271.pdf. It has no moving parts. A vortex tube 1 comprises a cold end 2, a hot end 3, and a tangential feed port 4 between the cold end and the hot end. At the hot end 3, a conical impedance 5 partially blocks flow. At the cold end 2 is a nozzle 6. A pressurized gas is injected into the feed port 4 and swirls down the wall of the tube in a feed vortex to the conical impedance 5 where it diverges into two streams: a cold stream and a hot stream, which are shown by arrows. The hot stream flows around the conical impedance 5 to exit as gas hotter than the feed and at lower pressure, and the cold stream flows back toward the cold end and out of the nozzle 6 as gas cooler than the feed and at lower pressure. Thermal separation is driven by the pressure drop.

Figure 2A:
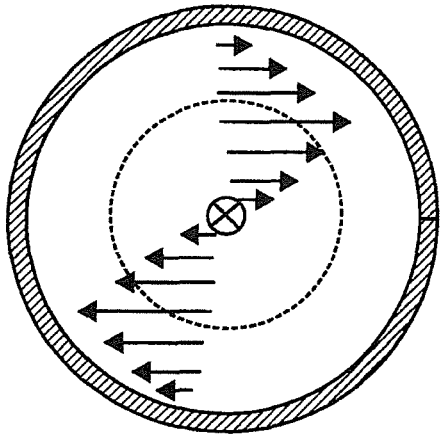
Fig. 2a PRIOR ART

FIG. 2*a* shows a cross-section of a steam vortex in a static vortex tube according to prior art, and its velocity profile about the vortex axis of rotation. For a static wall, as shown here, the velocity profiles decrease to zero radially outward from the vortex axis, which is shown by an x at the center of the vortex. A dotted line shows where radially inward flow (out of the page) in the vortex core separates from radially outward flow (into the page) at the vortex periphery.

Figure 2B:
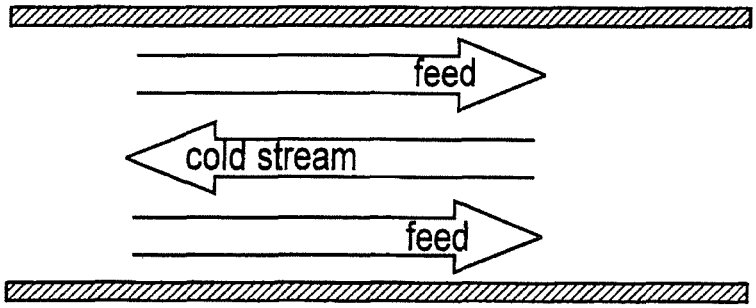
Fig. 2b PRIOR ART

FIG. 2*b* shows a longitudinal cross-section of the steam vortex shown in FIG. 2*a*. The vortex axis b-b is at the center of the vortex. A cold stream separates from the feed and flows to the left through the center of the vortex core, while simultaneously a hot stream flows to the right and out of the vortex tube. Feed pressure drives said counterflow, which is shown by velocity profiles parallel to the vortex axis b-b.

Figure 2C:
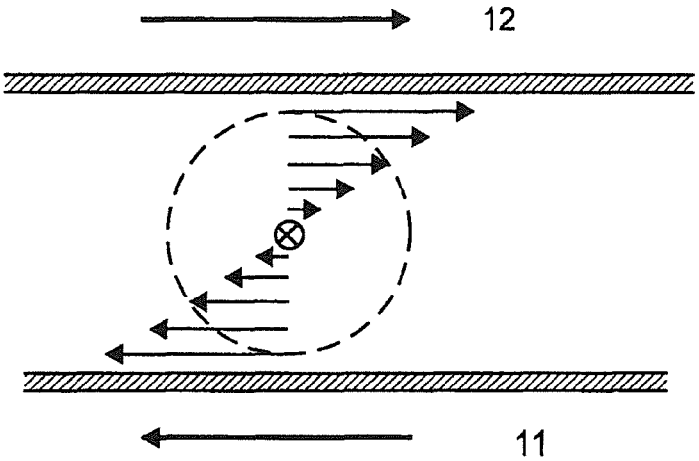

FIG. 2*c* shows a cross-section of a steam vortex in a dynamic steam condenser according to the present invention, and the velocity profile about the axis of rotation, shown by an x. The view is from the disk axis of rotation. Between the boundary layers against the impellers, where viscous diffusion of momentum occurs, is a shear layer comprising the vortex. Forced sink flow by suction at the vortex axis increases vorticity by stretching the vortex axis. Steam impinging the impellers loses enthalpy and condenses doing work turning the impellers.

Centrifugal separation of low density fractions (low enthalpy saturated vapor) and high density fractions (condensate, noncondensible gases, and high enthalpy saturated vapor) occurs in the vortex. Low density fractions concentrate at the vortex core, and high density fractions concentrate at the vortex periphery. At the vortex periphery, the high density fractions receive a radially outward momentum boost (into the page) from the counter-rotating disk surfaces. Viscous diffusion of momentum for said radially outward flow does not extend to the low density fractions at the center of the vortex core. Said low density fractions are advected in the opposite direction, out of the page, by said suction at the vortex axis.

Figure 2D:
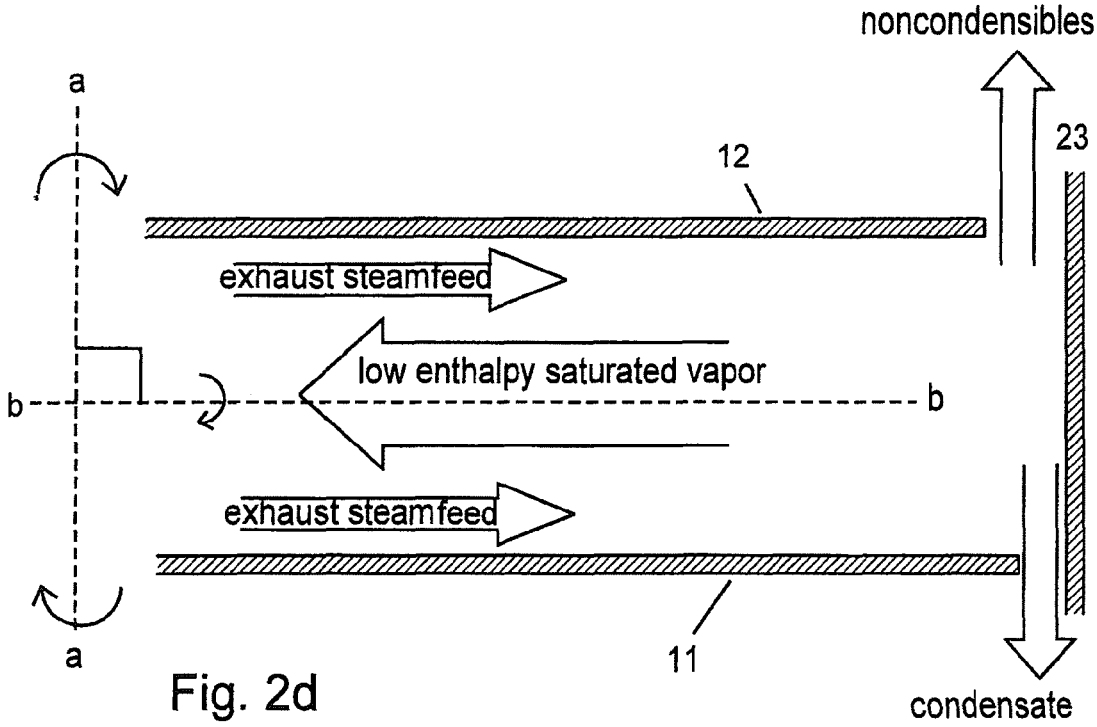

FIG. 2*d* shows a longitudinal section of the vortex shown in FIG. 2*c*, and the radial counterflow caused by said forcing regime of disk rotation and axial suction. The axis of rotation a-a of the disks is shown at the left, and is a low pressure sink. The vortex axis b-b is approximately orthogonal to the disk axis a-a. Flow from right to left of low density fractions toward the disk axis a-a is sink flow, which takes place at the center of the vortex core. A source flow of feed and high density fractions, advected by the disks acting as centrifugal impellers, is from left to right. A low density cold stream of low enthalpy saturated vapor separates from source flow and flows to the left parallel to the vortex axis b-b toward the disk axis a-a through the center of the vortex core, while simultaneously a hot stream of high density fractions flows to the right and into the next stage of a cascade in finer and finer-scale dynamic vortex tubes. The vascular network of low pressure gradients extending from the axis a-a to the periphery bifurcates into what becomes very fine-scale organized turbulence.

At each stage of the dynamic vortex tube cascade, a cold mass fraction of low enthalpy vapor is stripped from the hot stream of the stage before. The cold streams from later stages merge with the sink flow of prior stages in a vascular network, and the combined streams flow to the axis a-a and into the steam condenser 18. The steam condenser sustains the low pressure which drives the mass flow through the vascular network.

James Clerk Maxwell, author of the eponymous fundamental equations of electromagnetism, made an important contribution to the kinetic theory of gases by providing a formula to graph the distribution of molecule speeds in a gas. The Maxwell speed distribution of a gas is a bell-shaped curve having molecular speeds on its x-axis and the number of molecules having that speed on the y-axis. The peak of the curve is the most probable speed ($v_p$) found by the formula: $v_p=(2RT/M)^{1/2}$ [where R is 8.31 J/mol.K; M is molar mass in kg; and T is temperature in Kelvins]. Mean speed of molecules in the gas is given by the formula: $v=(8RT/\pi M)^{1/2}$, and the root-mean-square speed is given by the formula $v_{rms}=(3RT/M)^{1/2}$. For all temperatures, $v_p<\bar{v}<v_{rms}$.

The vortex tube cascade of the present invention strips the slow tail of the Maxwell distribution at each stage of the cascade, leaving the remainder as feed for succeeding stages of the cascade. Momentum transfer from the counter-rotating disks drives the mass flow through the later stages of the cascade, with the disks acting as flywheels storing the momentum from previous mass flow.

A vortex of exhaust steam comprises condensate, which is already present from the wet steam feed, noncondensible gases, and steam. The least dense of these fractions is the steam (molar mass 18 g/mol), which is much less dense than oxygen (32 g/mol), nitrogen (28 g/mol), or carbon dioxide (44 g/mol), and much less than condensate. Condensate and noncondensibles are centrifugated out from the vortex core to the vortex periphery due to their higher density. Steam collects at the vortex core.

From inspection of steam tables, the high enthalpy fraction of the exhaust steam has higher density than the low enthalpy fraction. Therefore the high enthalpy fraction is centrifugated out along with the condensate and noncondensibles, leaving the low density low enthalpy fraction at the vortex core. The high enthalpy fraction is the portion of the Maxwell speed distribution comprising the high velocity molecules, which have high kinetic energy. The low density fraction is the low enthalpy fraction, which is the portion of the Maxwell speed distribution comprising the low velocity molecules, which have low kinetic energy but which bear a heavy load of latent heat.

In the dynamic steam condenser disclosed in the present invention, the slow tail of the Maxwell distribution (which is the low enthalpy and easy-to-condense fraction of exhaust steam) concentrates at the cores of radial tree vortices, and is advected along the vortex axes radially inward to the axis of rotation a-a of the counter-rotating disks which are driven by the high tail, going in the opposite radial direction.

Stretching the vortex axes, by said radially opposite advection of the high and low tails of the Maxwell distribution, maintains coherence of the radial vortices which serve as sink flow conduits for low density, low enthalpy fraction saturated vapor into the condenser.

The high speed molecules of the Maxwell speed distribution, having their intrinsic speed directed tangential to the peripheries of tiny vortices, would experience very high g force for centrifugal gas separation from the low speed molecules loitering in the core of that vortex flow. Thermal separation in these microscopic gas centrifuges is collected through the opposite radial advection of the high enthalpy and low enthalpy fractions in the radial vortices due to the radial counterflow forcing regime of the counter-rotating centrifugal impellers and the axial pump.

Radial acceleration a of any molecule in a steam vortex is given by the formula $a=v^2/r$ [where v is tangential velocity in m/s; and r is the vortex radius in meters]. The radial acceleration a, divided by gravitational acceleration (9.81 $m/s^2$) on the surface of the Earth, gives the g for centrifugal separation. For the high speed molecules of the Maxwell speed distribution, v will be high, and therefore the high enthalpy fractions will experience higher g than the slower, low enthalpy fractions. In small-radius vortices, such as the small scale twigs in the radial tree vortices of the shear layer, the foregoing radial acceleration formula indicates that the radial acceleration a with respect to the vortex axis will be very high, so there should be excellent thermal centrifugal separation in the fractal turbulence. The separated fractions do not remix, but are oppositely advected in radial counterflow, with the low enthalpy fractions going radially inward to the axis a-a, and the high enthalpy fractions going radially outward to the periphery of the disks.

An example: the tangential velocity of a radial steam vortex is measured at a point 5 meters from the axis of rotation a-a of disks counter-rotating at 3 revolutions per second. The vortex radius r is 1 cm. With respect to the vortex axis, the radial acceleration (centripetal acceleration) $a=(2\times5\times\pi\times3)^2/0.01=888{,}264$ $m/s^2$ which is over 90,000 g. If the vortex radius is 1 mm, there is over 900,000 g for centrifugal separation of steam fractions according to density, and so on through the finer scale vortices in the shear layer.

Ordinarily, the very high g centrifugal separation of cold and hot fractions in steam vortices is transient due to isotropic turbulence, which remixes the separated fractions nearly instantly. The present invention provides means for collecting the microscopic separation effects of steam vortices in anisotropic turbulence in order that the cold vortex cores of innumerable tiny vortices can be stripped from exhaust steam or cooling water. A network of low pressure gradients penetrating a shear layer provides sink flow conduits for the cold streams from innumerable vortex tubes linked in a bifurcating cascade. The momentum transfer from the disks sustains feed pressure into the finer-scale dynamic vortex tubes as the cascade bifurcates out to the periphery, so the turbulence does not become isotropic.

Residence time of exhaust steam between the disks can be controlled by means of an annular shrouding wall 23 which causes (by the vortex-wall interaction) a recirculating flow toward the axial feed inlet. Long residence time allows for effective centrifugal separation of exhaust steam thermal fractions.

In the preferred embodiment for steam separation, discussed below under FIG. 5, the cold stream bears off the low enthalpy, low density saturated vapor to the steam condenser. Condensate, noncondensible gases, and high enthalpy steam are centrifugated out of the vortex cores and forced to do work, thereby losing enthalpy. High enthalpy steam, which is the high velocity tail of the Maxwell speed distribution, is forced to do work and thereby lose enthalpy so it can join the cold stream mass flow to the condenser. Thus, the steam condenser has an easier job, with reduced mass flow and lower enthalpy in what does enter. The otherwise wasted energy in exhaust steam is partially collected in useful work as the remainder condenses outside the condenser 18.

In the preferred embodiment for evaporative cooling of cooling water, discussed below under FIG. 9, a vapor stream at the vortex cores bears off latent heat. There is a high surface area in the radial fractal tree network of vortices, and a high mass flow sweeping vapor off the surface of the vortex network and into the condenser, thereby cooling the cooling water.

Figure 3:
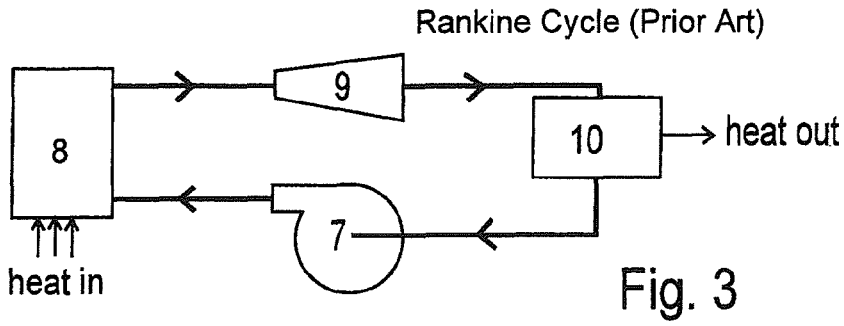
FIG. 3 shows a diagram of the Rankine cycle according to prior art.

FIG. 3 is a diagram illustrating the Rankine cycle used according to prior art for power generation. There are four basic elements in the conventional Rankine cycle: a pump 7, a boiler 8, a turbine 9, and a condenser 10. The condenser 10 comprises means for heat exchange with the environment, such as a cooling tower or an air cooler, so that heat is rejected out of the cycle. Heat is input into the cycle through the boiler, and part of the energy thus introduced is converted to work and exported through the turbine. As superheated steam from the boiler expands through the turbine and does work, it loses enthalpy and becomes saturated exhaust steam going into the condenser. At the condenser, the vapor becomes liquid once more. The pump pumps the condensate into the boiler and renews the Rankine cycle. A heat flow is shown through the system from the boiler through the condenser. There is also a work flow from the pump through the turbine.

It is advantageous for Rankine cycle efficiency to pull a high mass flow through the turbine by providing a low pressure sink at its exhaust. Condensation pulls a vacuum for this purpose. The latent heat is transferred to an external fluid, such as cooling water. Although some waste energy can be recycled in heating the feedwater to the boiler, and some of the exhaust steam can be reheated and reinjected into the turbine, most of the energy in exhaust steam is dumped into the atmosphere by evaporative cooling. This is a waste of water and of energy.

Turbine exhaust steam comprises condensate and noncondensible gases, both of which are a wasteful burden on the condenser. The steam is a high temperature saturated vapor which, because of its high temperature, has a broad Maxwell distribution of molecular speeds, comprising a large tail of high speed molecules mixed with the more easily condensed low speed molecules.

The present invention separates low speed steam molecules from the condensate, noncondensibles, and high speed molecules. The condenser has an easier job and Rankine cycle efficiency is improved. See the discussion of FIG. 5.

Figure 4:
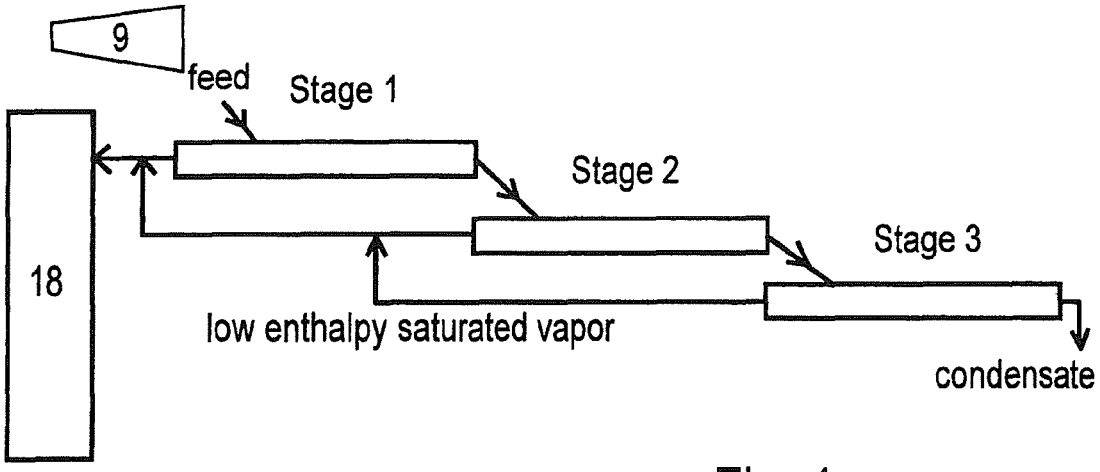
FIG. 4 shows a vortex tube cascade according to the present invention.
Figure 7:
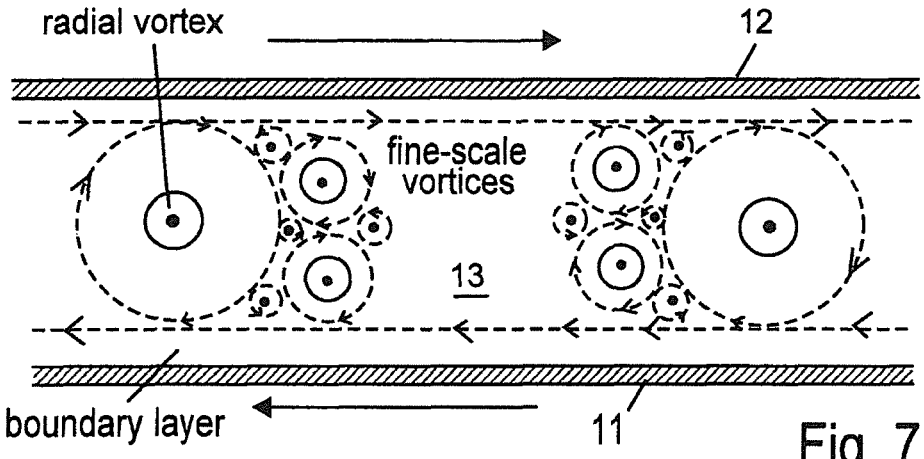
FIG. 7 shows a cross-section through the workspace, illustrating the boundary layers against the disks and the coherent vortices in the shear layer between them.

FIG. 4 shows a cascade of three vortex tubes. Shown are vortex tubes having solid walls, to make the illustration easier. The "tubes" of the preferred embodiments shown in FIG. 5 and FIG. 9 are dynamically created bifurcating vortices arrayed about the impeller axis of rotation a-a in radial tree networks spreading throughout a shear layer. High density fractions such as condensate, noncondensible gas, and high enthalpy steam are centrifugated out of vortex cores and concentrate in high density peripheral shells around the vortices in the shear layer. Adjacent forced vortices co-rotate and grind together at their peripheries, spawning turbulence comprising innumerable fine-scale vortices between them. The impedance created by the fine-scale turbulence about the larger-scale vortices confines the fluid in the larger-scale vortices, contributing to the "walls" of the vortex tube cascade. This is illustrated in FIG. 7.

A disadvantage of a cascade of static vortex tubes, such as the cascade disclosed by Schwieger U.S. Pat. No. 6,516,617 (2003), is that feed pressure must be restored by pumping between the stages, to maintain the separation effect in later stages. That disadvantage is avoided in the dynamic vortex tube cascade disclosed in the present invention because the momentum transfer from the counter-rotating disks pumps up feed pressure for later stages.

In Stage 1, exhaust steam from a turbine 9 swirls into a vortex tube and therein is separated into a cold stream and a hot stream, shown by flow arrows. The cold stream goes to the condenser 18 where it is condensed by suitable means known to the art, such as air coolers or water coolers. The hot stream becomes feed for Stage 2, where it separates into a hot stream and a cold stream. The cold stream from Stage 2 goes to the condenser 18, and the hot stream becomes feed for Stage 3. At each stage transition, the mass of the hot stream decreases as mass is stripped into the cold stream. What remains in the hot stream is condensate, high enthalpy steam, and noncondensibles.

The cold mass fraction stripped off at each stage of the cascade is saturated vapor having low specific enthalpy (energy content, measured in units of kJ/kg). This is the slow tail of the Maxwell distribution, the low speed molecules in the steam. It is sucked into the condenser because its pressure is higher than the pressure in the condenser. The flow of these low speed molecules is still in a gaseous state but is ready to condense and discharge its latent heat impinging the cold surfaces in the condenser. These slow molecules exert low pressure. The lower the steam pressure, the higher is the latent heat. So stripping off the slow tail into the low pressure network established by fractal turbulence will result in using only the steam which can carry a heavy latent heat load into the condenser, leaving the high enthalpy steam to dump its energy counter-rotating the opposed disk turbines. Stripping off the slow tail, leaving a significant portion of the exhaust steam mass doing work and condensing outside the condenser, reduces the mass flow into the condenser and thereby allows for lower condenser pressure at a given cooling water input, which improves plant efficiency.

Inspection of steam tables for saturated vapor reveals that specific volume ($m^3$/kg) of saturated vapor increases as temperature and pressure decrease. Specific volume is the inverse of density. In a vortex of saturated vapor, the vortex core, which as in any vortex is at lower pressure than the vortex periphery, has a higher specific volume (lower density) than the vortex periphery. Centrifugation in the vortex concentrates cool, low pressure, low enthalpy fractions at the vortex core and hot, high pressure, high enthalpy fractions at the vortex periphery. Condensate is centrifugated out of the vortex cores to the hot, high enthalpy steam at the vortex periphery and absorbs some of its energy, allowing the high enthalpy steam to become low enthalpy steam and then join the radially inward flow of the cold stream to the condenser. Noncondensible gases cannot join the cold stream because their density is higher than the density of water vapor, therefore noncondensibles are centrifugated out of the vortex core along with the condensate into the hot stream at each stage of the cascade.

For example, wet (quality=0.95) exhaust steam at a pressure of 2 bar has a saturation temperature of 120.2° C. Its enthalpy is the sum of the enthalpy of saturated liquid (condensate) and the enthalpy of saturated vapor (dry steam) at that temperature and pressure, which are 504.7 kJ/kg and 2201.9 kJ/kg respectively. The mass fraction of dry steam is 0.95 kg and the mass fraction of condensate is 0.05 kg. For a kilogram of exhaust steam, energy in the condensate is 0.05× 504.7 kJ/kg=25.2 kJ. That liquid energy should not be going into the condenser because the liquid does not need condensing and liquid water at 120.2° C. films and heats up the cooling tubes, thereby impeding the task of extracting latent heat into the tubes so the vapor can condense. The energy in the vapor is 0.95×2201.9=2091.8 kJ. Let us stipulate that the condensate dripping off the tubes into the hotwell is at 40° C. The pressure in the condenser is the saturation pressure at this temperature, or 0.07 bar.

The vortex core pressure will be lower than the 2 bar feed pressure, because the vortices are low pressure gradients, where the pressure drops radially inward to the condenser. Let us select a point in the cascade where the core pressure is 0.3 bar, which is still greater than the condenser pressure of 0.07 bar, so flow is from the vortex core into the condenser. The saturation temperature of the stripped dry steam is 69° C., and its enthalpy is 2625.3 kJ/kg, comprising 2336.1 kJ/kg latent heat. Recall that the specific enthalpy of the vapor in the exhaust steam (120.2° C.) was only 2201.9 kJ/kg. So each kilogram of mass going into the condenser is carrying a higher latent heat load than the exhaust steam, at a lower temperature, and without the condensate.

The flow into the condenser 18 is pushed by axial jetting due to the vortex-wall interaction in the vortex tube (see FIG. 8), and pulled by the lower pressure of the condenser 18.

Figure 5:
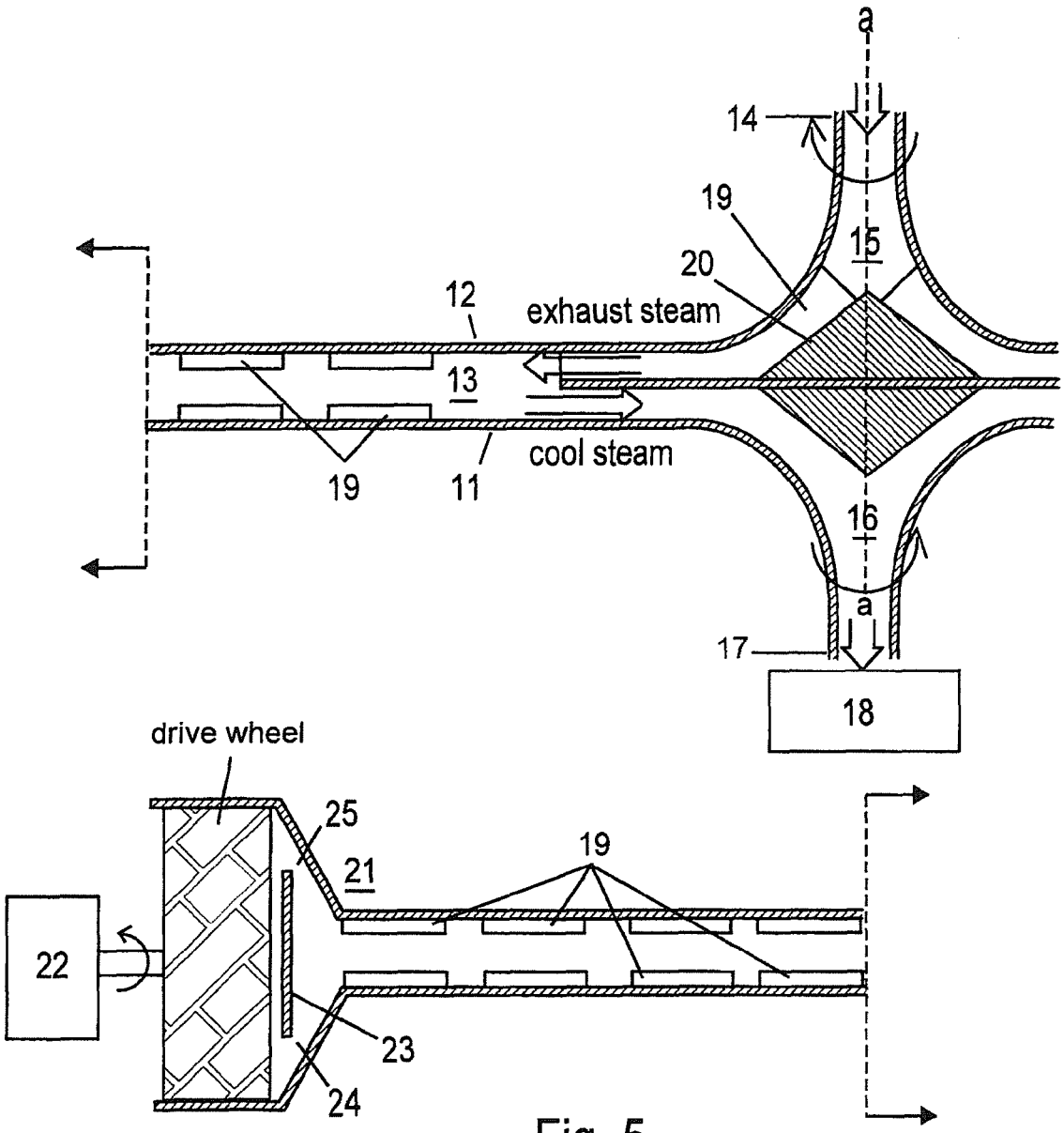
FIG. 5 shows a schematic cross-sectional view of approximately one half of the preferred embodiment of the present invention for use as a radial counterflow steam separator.

FIG. 5 shows a cross-sectional schematic view of approximately half of the preferred embodiment for practicing the vortex tube cascade method of the present invention for exhaust steam separation. The vortex tube cascade is an array of radial vortex trees between counter-rotating disks, with finer and finer scale vortices constituting a multitude of successive stages in the cascade as flow of feed to the cascade goes radially outward from the axis a-a. The "walls" of the vortex tube cascade are the peripheries of the vortices in the vortex trees. At said peripheries is a concentration of high density fractions in exhaust steam, including condensate, noncondensible gases, and high enthalpy vapor, each of which is denser than low enthalpy vapor at the vortex cores. Surrounding each vortex periphery is a turbulent sheath of finer-scale vortices, which serves to constrain rotating flow and to keep the vortex coherent. High density fractions of one stage become the feed to the next stage of the cascade.

Opposed counter-rotatable radial flowdisk turbines 11, 12 having a common axis of rotation a-a define between them a workspace 13. The disks are preferably connected to means for causing them to counter-rotate such as drive motors, in order to facilitate startup. In the following discussion, exhaust steam is the motive force for disk rotation and for power generation through the peripherally disposed drive wheels 22, but supplemental motive force for the disks will be necessary as they are started up because the disks have high rotational inertia. The drive wheels 22 for dynamos act as braking means to control disk speed. Converting the dynamos to motors on startup would get the disks up to the desired speed for operation. The disks act as flywheels, storing angular momentum from prior steam processing to transfer some of that momentum to the incoming feed. Momentum transfer from the disks drives mass flow through the dynamic vortex tube cascade in the shear layer between the disks.

An axial feed conduit 14 introduces exhaust steam through an axial feed port 15 into the workspace 13 between the counter-rotating disks 11, 12. The axial feed port 15 is at the center of the top disk 12. An axial exhaust port 16 at the center of the bottom disk 11 communicates with an axial exhaust conduit 17 which in turn communicates with a condenser 18. The condenser may be an air cooled surface condenser, a water cooled surface condenser, or other type of steam condenser known to the art.

Figure 6:
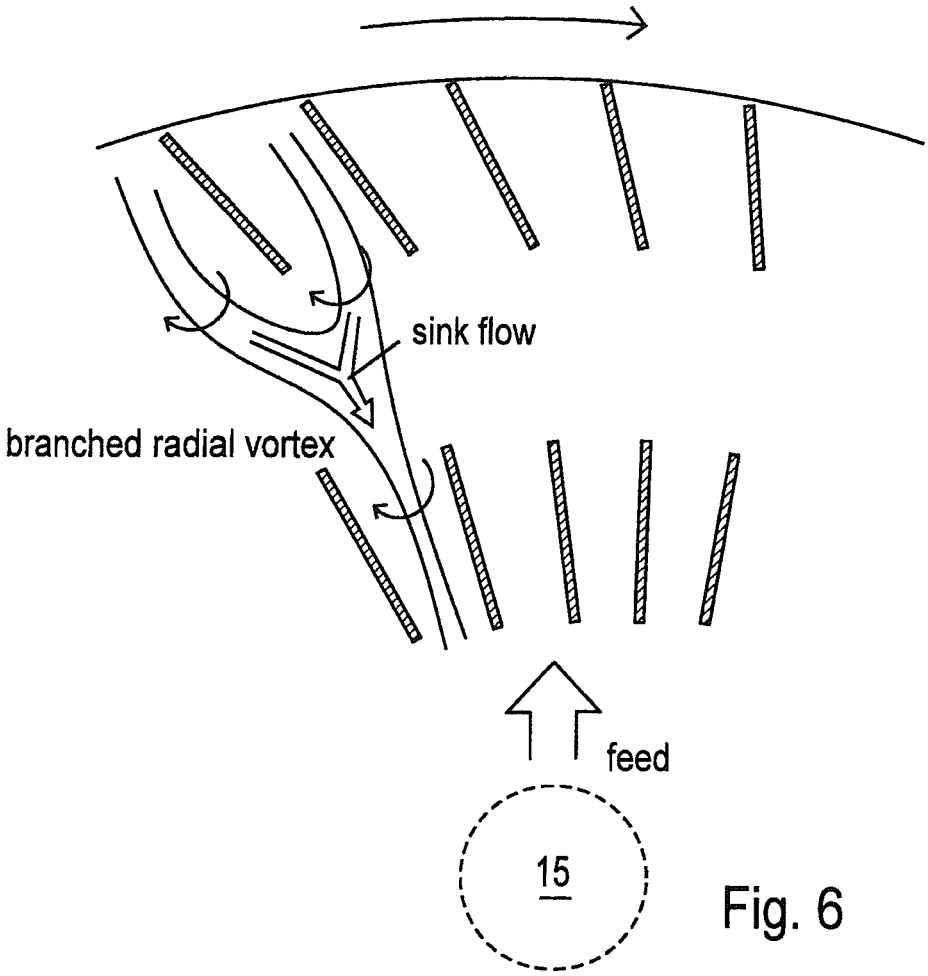
FIG. 6 shows a detail top view of the bottom impeller and its runners, and of the shrouding wall.

Each radial flow disk turbine 11,12 comprises runners 19 facing the workspace. The arrangement of runners on a disk is shown in FIG. 6. The runners are disposed in annular groups and extend into the workspace 13 from the disk. The runners are preferably of durable and not brittle material suitable for operation in the temperature of the exhaust steam. Exhaust steam introduced through the axial feed port 15 expands into the workspace 13 and impinges on the runners 19, thereby causing the disks 11,12 to rotate in opposite directions about the axis a-a. Erosion of the runners is prevented by the very small angle of the flow path of the steam to the surface of the runners. It can be seen that this arrangement is similar to the runners of a centrifugal pump, only in this case it is the fluid which moves the impellers and not vice versa.

A baffle 20, connected by spiral runners 19 to the top disk 12, is disposed opposite to the axial feed port 15. The baffle and its attached runners direct exhaust steam introduced through the axial feed port 15 into a radially outward feed flow from the axis a-a through the workspace 13 to a periphery 21 of the workspace which is at the edge of the disks 11,12. The baffle and its runners is rotated along with the top disk 12 by the exhaust steam mass flow through the workspace. The baffle 20 provides insulation of the axial exhaust port 16 from the axial feed port 15. Mass and heat cannot flow directly into the axial exhaust port 16 from the axial feed port 15, but must flow radially outward and then radially inward in the workspace 13 first. The baffle 20 shown in the preferred embodiment is two cones conjoined at their bases and disposed in the workspace such that the apex of each cone points to a port. Flow directions around the baffle 20 are shown by arrows.

The workspace is a divergent nozzle for radially outward exhaust steam feed flow through the workspace 13. In its expansion, the exhaust steam also does work, impelling the disks in opposite directions about the axis a-a by impingement on the runners on the disks, as mentioned above. Impingement causes the exhaust steam to lose enthalpy, and to condense. Condensate, noncondensible gases, and impinging steam continue to push on the runners 19 as flow continues radially outward from the axis a-a.

At the periphery 21 are drive wheels 22. The drive wheels 22 engage the disks 11,12 such that rotation of the disks causes the drive wheels to rotate and generate electricity. On startup, motors instead of generators are connected to the drive wheels, and rotation of the drive wheels causes the disks to counter-rotate. Disk rotation is maintained at the desired speed by means of the drive wheels and their associated motors/dynamos which act as movers/brakes.

Figure 9:
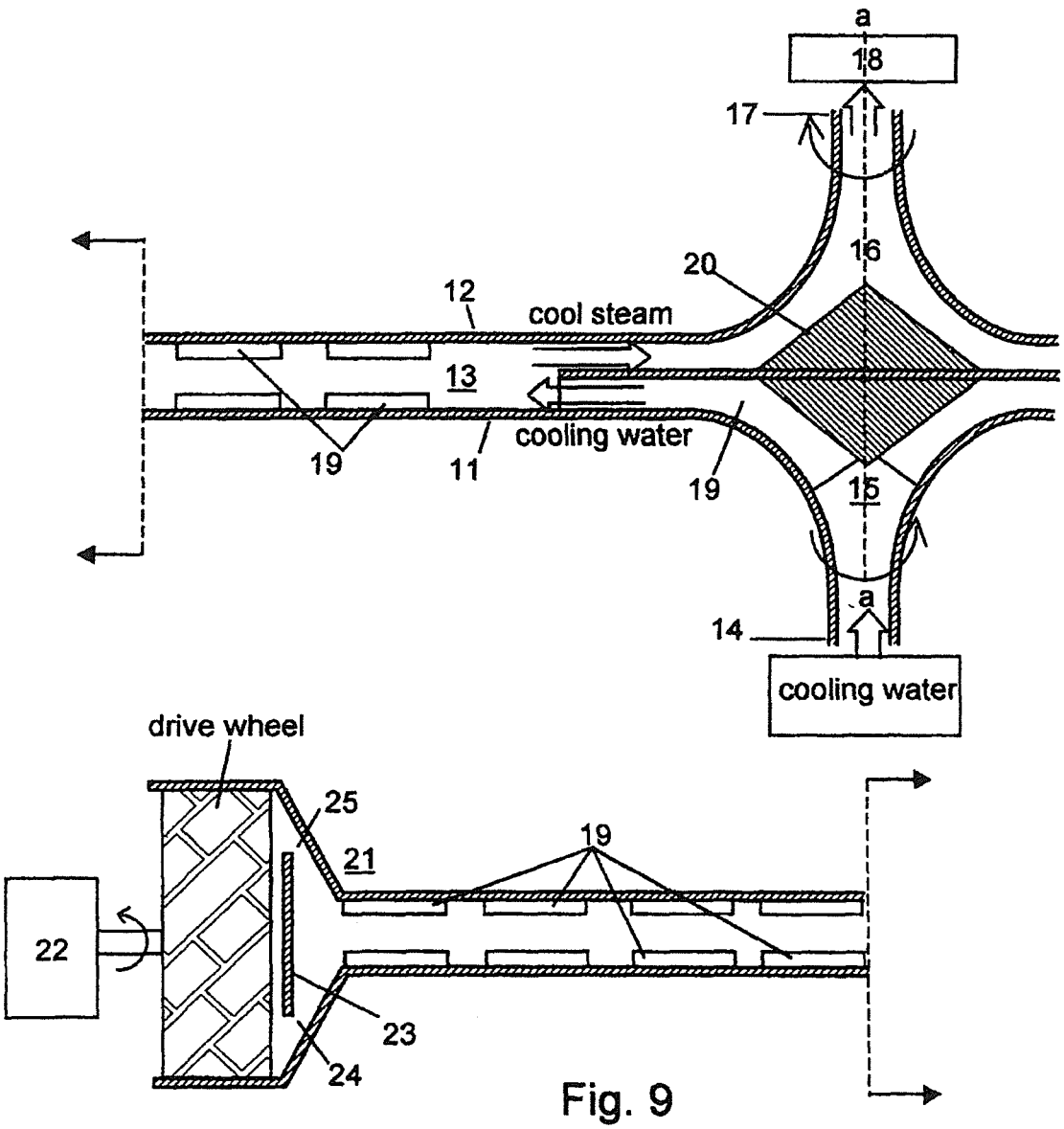
FIG. 9 shows a schematic cross-sectional view of approximately one half of the preferred embodiment of the present invention for use as a radial counterflow evaporative cooler.

Current produced by the generators which are connected to the peripheral drive wheels 22 is preferably used to power the centrifugal pumps of the cooling water chiller shown in FIG. 9. Or the extra power from the work of the hot stream could increase the output of the plant.

As steam flows radially outward from the axis a-a, the radial vortices in the shear layer of the workspace 13 bifurcate into finer and finer-scale vortices having higher and higher mass fractions of condensate at their peripheries and more and more coherent walls constraining the faster and faster rotation of their smaller and smaller-radius vortices, and thus higher and higher g for vortex separation of cold and hot fractions in exhaust steam.

At the periphery 21 is a shrouding wall 23 facing the workspace. Condensate and noncondensibles exit the workspace around the shrouding wall because they are advected radially outward against the disks 11,12. The shrouding wall adds to the drag on radially outward flow through the shear layer. Steam vortices of the shear layer encountering the shrouding wall 23 experience the vortex-wall interaction, illustrated in FIG. 8. In the vortex-wall interaction, a strong rebounding axial jet through the core of the vortex increases its vorticity and tightens the vortex for extreme centrifugal separation. The back pressure on vortex cores in the shear layer drives sink flow through vortex cores radially inward toward the axis a-a, through the axial exhaust conduit 17 and into the condenser 18.

High pressure during impingement of the steam vortex periphery on the shrouding wall adds to the condensate exiting the periphery, which is drawn off through a condensate drain 24 and pumped into the boiler to renew the Rankine cycle. Preferably, the shrouding wall 23 comprises means for circulating external cooling fluid such that the shrouding wall acts as a surface condenser.

The condenser 18 draws a vacuum which causes mass flow radially inward through the workspace 13 and through the axial exhaust port 16. The mass flow through the axial exhaust port 16 and into the condenser 18 is saturated vapor having an enthalpy (kJ/kg) less than the enthalpy of the exhaust steam flowing through the axial feed port 15 but bearing a higher latent heat load per unit mass.

Noncondensible gases in the exhaust steam feed are excluded from said radially inward mass flow by their higher density. The molar mass of the noncondensible gases (such as $N_2$, which is 28 g/mol, and $O_2$, which is 32 g/mol) is higher than the molar mass of dry steam (18 g/mol). Noncondensibles continue radially outward and are exhausted at the disk periphery through a noncondensibles vent 25 by suitable means.

Against each of the disks 11,12 is a boundary layer. The disks act as flywheels, storing steam energy from previous flow and by their rotational inertia providing means for forcing anisotropic turbulence in the workspace 13. This is shown in FIG. 7. Between the counter-rotating boundary layers is a free shear layer comprising anisotropic fractal turbulence in a vascular network of low pressure gradients communicating ultimately with the condenser, allowing for continuous extraction of low enthalpy vapor from the shear layer into the condenser.

Von Karman swirling flow, in an open system, with s ~−1 and disk separation very much less than disk radius, sets up in the workspace 13, providing means for radial counterflow of hot streams radially outward, and cold streams radially inward, simultaneously, with respect to the axis a-a. The system is open because there is continuous mass flow in (through the axial feed port 15) and out (through the axial exhaust port 16 and the periphery 21 of the workspace 13). Radial vortices extend from the axis a-a like spokes in a wheel. The radial vortices provide coherent conduits through the workspace for continuous sink flow into the axial exhaust port 16. The radial vortices bifurcate into finer and finer-scale vortices radially out from the axis a-a. A tree-like fractal network of low pressure gradients provides a branching projection into the workspace 13 of the vacuum created by condensation in the condenser 18. The low pressure gradient network also provides means for continuously extracting low enthalpy mass fractions from the exhaust steam, leaving the feed energy concentrated in the hot stream and doing work pushing the disks.

The vortex tube cascade explained under the discussion of FIG. 4 is here practiced in the radial vortex trees in the shear layer. Fine-scale vortices of turbulence near the periphery feed cold streams to larger-scale vortices more radially inward with respect to the axis a-a, and there is an opposite radial flow of hot streams from larger to finer-scale vortices.

Radial counterflow of hot and cold streams in the vortex cascade effects thermal separation of mass flow such that the hot stream can do useful work and thereby lose enthalpy and become condensate outside of the condenser, while the cold stream is easily condensed in a condenser known to the art.

FIG. 6 shows a top view of a section of the bottom disk 11 comprising runners 19 disposed in annular arrays. Shown here are straight runners slanting left to right such that flow of exhaust steam between them causes rotation counter-clockwise, as shown by the arrow. The art of turbine blade design is very well developed, and curved runners may be preferable according to the knowledge of those of ordinary skill in that art. The important characteristic of the impellers is that they are resistant to erosion by impinging mist or imploding vapor. The angle of incidence of impinging mist and vapor is very small, so the runners are struck a glancing blow and wet steam, condensate, and noncondensibles slide over them. Preferably, the runners are coated with durable and flexible material which resists spalling and which will not degrade at the temperature of the exhaust steam of the turbine used. For example, thermoset urethane.

Alternatively, the runners 19 could be continuous spirals. When the disks 11,12 are disposed opposite each other, as in the preferred embodiments shown in FIG. 5 and FIG. 9, the spirals, viewed from above in superposition, would be of opposite sense. In other words, the spirals, viewed together from above with the top disk invisible, would have numerous points of intersection where the runners 19 of the opposing disks are close together. Exhaust steam flowing from the axis a-a radially outward through the workspace 13 between the disks impels the disks to counter-rotate about the axis a-a. Annular arrays of runners would likewise slant in opposite directions, viewed in superposition, to cause the disks 11, 12 to rotate in opposite directions about the axis a-a.

The exhaust steam is fed into the workspace 13 through the axial feed port 15, shown by the dashed circle because it is a central opening in the top disk 12, not shown. A radial vortex is shown in the workspace above the disk and its runners. The top disk 12 also comprises runners, but its runners slant right to left when seen in superposition to the runners of the bottom disk 11. The top disk therefore rotates clockwise due to flow of exhaust steam, opposite to the rotation of the bottom disk. Counter-rotation of these opposed low pressure disk turbines 11,12 causes a shear layer between them comprising radial vortices therein. The radial vortices are sink flow conduits for saturated vapor radially inward to the common axis of rotation of the disks. A shrouding wall 23 just outside the periphery of the disks 11,12 intercepts radially outward flow of exhaust steam and causes a vortex-wall interaction which drives sink flow through the radial vortices of the shear layer. The vortex-wall interaction is explained under the discussion of FIG. 8. A condensate drain 24 communicating with the inlet of the boiler feed pump of the Rankine cycle (not shown) provides means for extracting condensate emitted from the workspace between the counter-rotating disks 11,12. Noncondensibles are exhausted through a noncondensibles vent 25 at the periphery 21 of the workspace 13 by suitable means. A noncondensibles pump, such as a steam ejector, communicating with the noncondensibles vent 25 would help to drive radially outward flow through the workspace 13.

Preferably the shrouding wall 23 comprises suitable means for heat exchange. Such suitable means for heat exchange could include a jacket of chilled external cooling fluid communicating with separate heat rejection means such as a brine chiller. Condensation of exhaust steam at the shrouding wall causes a peripheral vacuum drawing more exhaust steam through the workspace between the counter-rotating disks 11, 12. Condensate drips into a collector and is pumped back to the boiler to renew the Rankine cycle. Noncondensibles vent to the atmosphere.

FIG. 7 shows a cross-section of the workspace 13 between the disks 11,12 wherein is a multitude of vortices of many scales. Counter-rotation of the disks causes a shear layer between boundary layers. The boundary layers flow radially outward, into the page. The boundary layers are where viscous diffusion of momentum occurs between the disks and the exhaust steam feed, which causes the disks to rotate in opposite directions, as shown. A boundary layer comprising high enthalpy steam, condensate, and noncondensibles rotates at the same velocity as the rotating disks. The disks are impelled by the impinging steam, and serve as flywheels to store angular momentum from prior mass flow so as to drive mass flow into the finer-scale stages of the dynamic vortex tube cascade between them.

In radially outward flow, into the page, the wet exhaust steam feed is impeded by the turbulent drag force of the shear layer and the drag force from the disk surfaces and their associated runners, but aided by the expanded space radially outward from the axis a-a between the disks, which is a divergent nozzle, and by the rotation of the disks, which advects the boundary layers against them. So the vapor in the exhaust steam will be impeded, and the condensate and noncondensibles will be expedited, in radially outward flow. Mass flow radially outward causes the disks to counter-rotate about the axis a-a and the angular momentum is stored as in a flywheel. The angular momentum imparted by prior steam feed is used to spin the vortices of later feed, thereby overcoming the problem of pressure drop at later stages of a vortex cascade. Angular momentum which is in excess of that required for spinning the steam vortices can be used to drive a generator and add to the power production of the plant.

The shear and outward advection between the counter-rotating disks, and the axial suction from the condenser drawing a vacuum at the disk axis a-a, constitute a radial counter-flow forcing regime which continuously advects high density fractions (condensate, noncondensibles, and high enthalpy steam) radially outward from the axis a-a in the boundary layers, and low density fractions (low enthalpy steam) radially inward through a sink flow network of radial vortices in a shear layer between the disks. The portion of the exhaust steam which is against the disks pushes them and causes them to counter-rotate. In doing work causing the disks to counter-rotate, high enthalpy saturated vapor loses enthalpy and thereby loses quality. Low enthalpy steam is extracted in the radial vortices, and the condensate proceeds radially outward. As exhaust steam flow proceeds radially outward (into the page), it comprises a higher and higher weight percentage of condensate.

High density fractions in the exhaust steam feed, such as condensate, noncondensible gases, and high enthalpy steam, are denser than low enthalpy saturated vapor. The vortex cores of the radial vortices in the shear layer between the disks 11, 12 will therefore be low enthalpy saturated vapor. In the shear layer are numerous vortices of many scales. An exaggerated cross-section of vortex cores is shown here for illustration, with the direction of rotation of adjacent vortices in the shear layer. At the peripheries of adjacent large-scale radial vortices, innumerable fine-scale vortices constrain the large-scale vortices, by their turbulent drag and by their high condensate and noncondensibles content.

The effect of the peripheral turbulence is similar to that of a physical wall in a vortex tube. In the fine-scale turbulence, high rotation speed in a vortex of small radius creates very high g which centrifugally separates and radially stratifies high and low density fractions about the vortex axis. Of course, there are many scales too fine to show here, but about the vortices of each scale there is a peripheral boundary of even finer-scale turbulence confining rotation. Regardless of rotation direction and vortex scale, predominantly the vortex axes are radial to the axis a-a. The radial alignment of vortex axes in the shear layer is because of: (1) the counter-rotation of the disks 11, 12; (2) the suction of the condenser through the low pressure gradients of the shear layer, and (3) the axial jetting of vortex cores due to the vortex-wall interaction (see FIG. 8).

For steam condensing, as discussed regarding FIG. 5, low enthalpy saturated vapor substantially free of condensate and noncondensibles is an easier job than high enthalpy, low quality turbine exhaust steam.

For cooling water cooling, as discussed below regarding FIG. 9, the vortex peripheries are high density cool water, and the vortex cores are low density warm water and low density saturated vapor. Stripping out the vaporous vortex cores radially inward (into the page) produces a concentration of cold water in the radially outward flow through the boundary layers, into the page.

By reducing the heat load going into the cooling water by low enthalpy steam stripping and forcing high enthalpy steam to do work, and by dynamic evaporative cooling of the cooling water by fractal turbulence, water waste is avoided and energy efficiency is increased.

Figure 8:
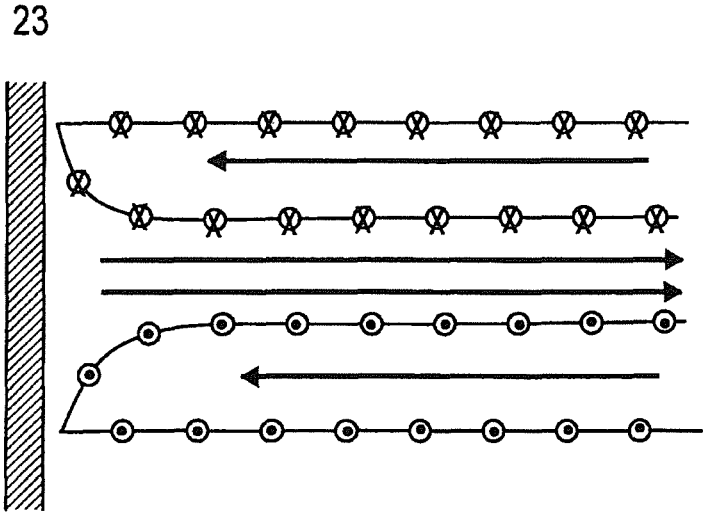
FIG. 8 shows the vortex-wall interaction as vortices of the shear layer encounter a shrouding wall at the periphery of the disks.

FIG. 8 illustrates the vortex-wall interaction. See V. Shtern, et al., *Ann. Rev. Fluid Mech.* 1999, 31:537-66, pp. 540-42, 545-46, 551 (1999). A radial vortex impinges a wall, such as the shrouding wall 23. Vortex rotation is shown by the dot and cross convention.

The vortex rotation suddenly stalls, which causes constriction and an axial rebound jet through the vortex core, shown by the straight solid streamlines. The axial rebound jet is in the opposite direction to the incoming vortex, away from the shrouding wall 23. The axial rebound jet has high axial vorticity and high axial momentum. The vortex cores from the vortex-wall interactions of turbulent vortices of the shear layer contain low density, low enthalpy saturated vapor, which is pushed toward the condenser 18 by the vortex-wall interaction. Conservation of angular momentum during impingement increases the angular velocity of the vortex, centrifugating out the high density fractions, such as condensate, which may be mixed with the cool steam in the vortex cores.

Impingement of the vapor vortex on the shrouding wall 23 compresses the vapor. A film of condensate covers the shrouding wall and condensate is sucked through a drain 24 (not shown here, see FIG. 6) by the boiler feed pump of the Rankine cycle (not shown).

After taking a detour from the condenser and doing work turning the generators and impinging on the shrouding wall, the high enthalpy saturated vapor mass fraction in the exhaust steam yields condensate which is collected through the condensate drain 24. The low enthalpy saturated vapor mass fraction, i.e., the slow tail of the Maxwell distribution, goes out of the axial exhaust conduit 17 and into the condenser 18 where it is condensed by suitable means known to the art.

FIG. 9 shows a schematic cross-sectional view of approximately one half of the preferred embodiment of the present invention for dynamic evaporative cooling of cooling water. This drawing shows one cell of a battery of such devices, for replacing cooling towers as means for cooling the cooling water from water-cooled heat exchangers.

A feed of cooling water is evaporatively cooled in simultaneous source-sink flow, or radial counterflow, through a workspace 13 between counter-rotating disks 11, 12. Drive wheels 22 connected to motors (not shown) cause the disks 11,12 to counter-rotate about the axis a-a and thereby to advect fluid radially outward, while simultaneously a condenser draws a vacuum at the axis a-a and thereby advects fluid radially inward. Simultaneous source-sink flow, or radial counterflow, occurs in the workspace 13.

Feed into the workspace is at the axis a-a. Cooling water flows radially outward, and saturated vapor flows radially inward. Condensation of vapor in a condenser 18 communicating with the workspace 13 through an axial exhaust conduit 17 maintains the vacuum at the axis a-a and helps to drive sink flow of saturated vapor out of the workspace.

Vapor is stripped through vortex cores of a radial vortex tree array in the free shear layer between the disks, in von Karman swirling flow driven by the radial counterflow forcing regime comprising the disks and the condenser. This is an open system, with simultaneous mass flow in through the axial feed port 15 and out through the axial exhaust conduit 17 and the periphery 21. Evaporative cooling of the radially outward-flowing feed of cooling water lowers its temperature. Vapor extracted through the radial vortices in evaporative cooling may be exhausted to the atmosphere or recovered as distilled water. The radial tree vortices in the shear layer have a large surface area and a high driven mass flow over that surface area, so evaporative cooling is quick and intense.

Opposed counter-rotatable disks 11, 12 having a common axis of rotation a-a define between them a workspace 13. An axial feed conduit 14 introduces cooling water through an axial feed port 15 into the workspace 13. The axial feed port 15 is at the center of the bottom disk 11. An axial exhaust port 16 at the center of the top disk 12 communicates with an axial exhaust conduit 17 which in turn communicates with a condenser 18. The condenser may be an air cooled surface condenser, a water cooled surface condenser, a chiller, or other type of steam condenser known to the art. The axial exhaust conduit 17 provides means for advecting saturated vapor from the workspace 13 to the condenser 18. A booster pump (not shown), such as a centrifugal pump or a steam ejector, intermediate to the axial exhaust conduit 17 and the condenser 18, could assist advection of vapor out of the workspace 13. In operation, a vacuum is maintained at the axis a-a while the disks 11,12 counter-rotate about the axis a-a.

The surface of the disks facing the workspace comprises centrifugal pumping means for advecting cooling water radially outward from the axis a-a. Although the disks 11, 12 rotate in opposite directions, each is a centrifugal impeller for cooling water.

A baffle 20, connected by spiral runners 19 to the bottom disk 11, is disposed opposite to the axial feed port 15. The baffle and its attached runners direct cooling water introduced through the axial feed port 15 into a radially outward feed flow from the axis a-a through the workspace 13 to a periphery 21 of the workspace which is at the edge of the disks 11,12.

The baffle and its runners is rotated along with the bottom disk 11 by the drive wheels 22 or other suitable means. The baffle 20 prevents flow into the axial exhaust port 16 directly from the axial feed port 15. Cooling water is caused to flow radially outward in the workspace 13. The baffle shown in the preferred embodiment is two cones conjoined at their bases and disposed in the workspace such that the apex of each cone points to a port. Flow directions around the baffle 20 are shown by arrows.

At the periphery 21 is a shrouding wall 23 facing the workspace. Vortices of the shear layer encountering the shrouding wall 23 experience the vortex-wall interaction, illustrated and discussed above in FIG. 8. In the vortex-wall interaction, a strong axial jet backwards through the core of the impinging cooling water vortex increases its vorticity and tightens the vortex for extreme centrifugal separation. Low pressure at vortex cores causes fine-scale capillary vortices to form, and the capillary vortices link with larger-scale vortices in a vascular radial tree network of low pressure gradients throughout the shear layer in the cooling fluid between the counter-rotating disks 11,12. Evaporative cooling of the cooling water occurs through the large surface area swept by radially inward mass flow through the vortex network into the condenser.

The condenser 18 draws a vacuum which causes mass flow radially inward through the vortex networks in the workspace 13 and through the axial exhaust port 16. The mass flow through the axial exhaust port 16 and into the condenser 18 is principally saturated vapor bearing off latent heat from the cooling fluid.

Against each of the disks 11,12 is a boundary layer where viscous diffusion of momentum occurs and cooling water rotates along with the disk. This is shown in FIG. 7. Between the counter-rotating boundary layers is a free shear layer comprising anisotropic turbulence, i.e., the radial vortex network discussed above. Von Karman swirling flow, in a open system, sets up in the shear layer of the workspace, providing means for continuous radial counterflow of cooling water radially outward from axial feed, and of saturated vapor radially inward to axial extraction.

Radial vortices extend from the axis a-a like spokes in a wheel. The radial vortices provide coherent conduits through the workspace for arterial sink flow into the axial exhaust port 16. The radial vortices bifurcate into finer and finer-scale vortices radially out from the axis a-a. A tree-like fractal network of low pressure gradients provides a branching projection into the workspace 13 of the vacuum created by condensation in the condenser 18. The low pressure gradient network also provides means for continuously extracting vapor through a large surface area. The vapor may be recovered out of the condenser as valuable distilled water as a byproduct of power generation.

Evaporative cooling, or chilling, of the cooling water dynamically according to the present invention chills the cooling water to a low temperature so the pressure in the steam condenser is reduced, and the efficiency of the plant is increased. Water is not wasted into the atmosphere. Cooling towers may be supplemented or even replaced by the present invention.

The cooling water vapor condenser preferably comprises a cooling fluid circuit comprising a refrigerant other than water. For example, the cooling fluid could be brine, which in turn is chilled by a refrigerant. The ultimate heat rejection into the environment does not involve the discharge of vapor. Instead, means known to the art of refrigeration, such as compression of refrigerant vapor in combination with forced convection air cooling of heat exchange fins, or forced convection of environmental water without boiling, for example, takes the latent heat from the refrigerant and discharges it to the environment. Air cooling is feasible because the heat load to the cooling water circuit, and hence to the cooling water vapor condenser and its associated refrigerant, has been ameliorated by thermal separation of the exhaust steam to segregate the high enthalpy steam, which is the high velocity tail of the Maxwell distribution, as detailed above.

A system, comprising (1) an improved exhaust steam condenser according to FIG. 5 for stripping low enthalpy saturated vapor from exhaust steam and directing the high enthalpy steam, condensate, and noncondensibles to do useful work, and (2) a radial counterflow chiller according to FIG. 9 which evaporatively cools the cooling water used in said improved condenser, and rejects heat without evaporation into the environment, would significantly reduce water waste and improve thermal efficiency of power plants, especially if the useful work done by the high enthalpy exhaust steam fraction goes to power the radial counterflow chiller.

Figure 10:
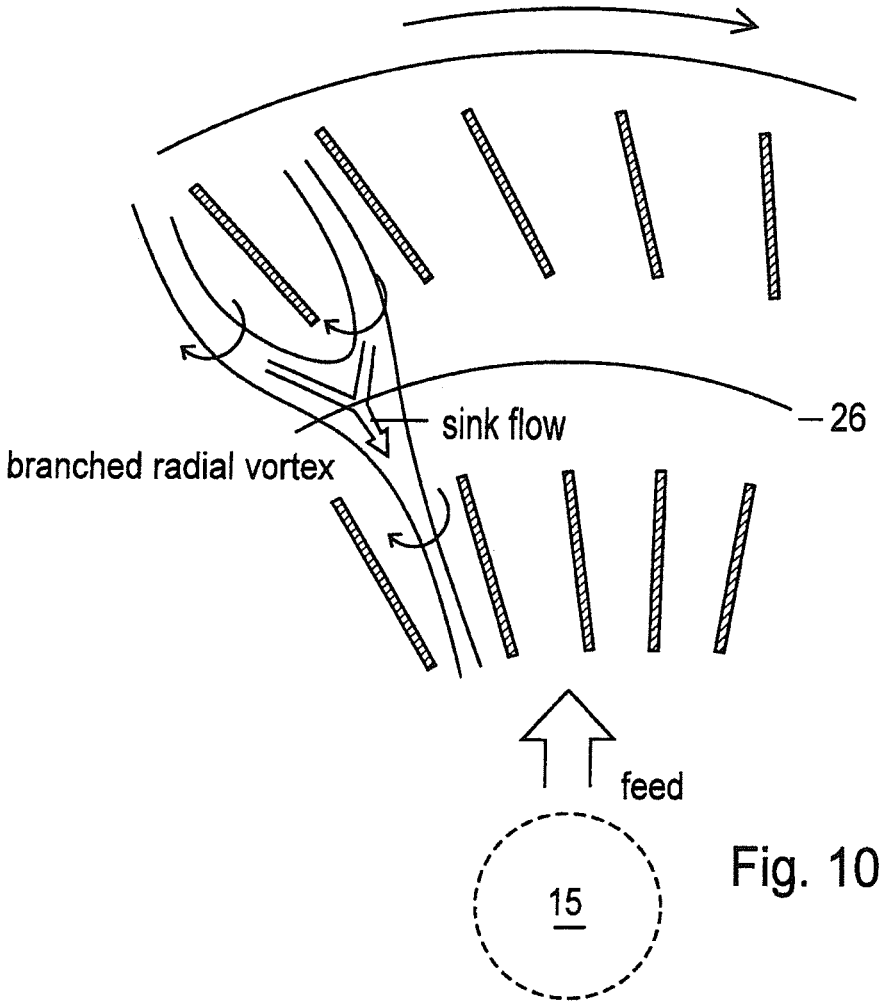

FIG. 10 shows a detail top view of an impeller 26 of the cooling water chiller shown in FIG. 9. A bifurcated radial vortex acts as a conduit for sink flow of saturated vapor into the condenser. Feed flow of cooling water comes from the axial feed port 15 and flows radially outward simultaneous with said sink flow of saturated vapor. Radially outward flow of feed is driven by rotation of the impeller, which is caused by the peripheral drive wheel. The impeller is a centrifugal pump.

Figure 11A:
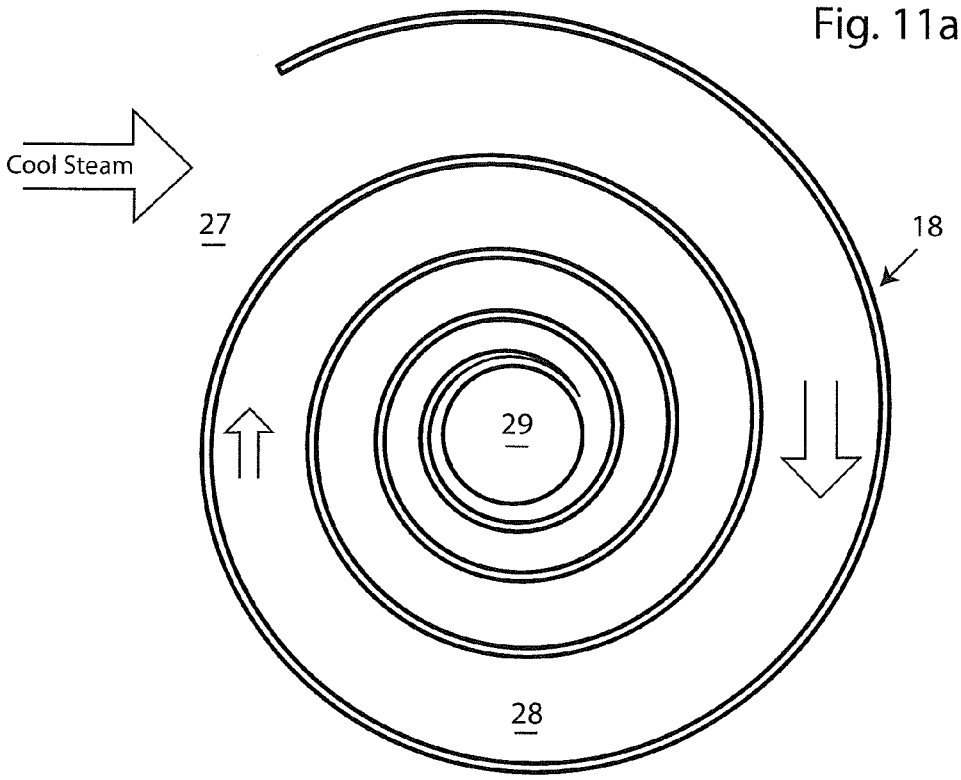

FIG. 11*a* shows a top sectional view of a scroll condenser for receiving a flow of low enthalpy saturated vapor. This is an alternative embodiment of the condenser 18 mentioned in the foregoing discussion of FIG. 5 and FIG. 9. The vapor flows radially inward from the entrance, through the scroll volute passage 28, and into a condensate pipe 29. During said flow, the vapor discharges its latent heat into a cooling fluid 30 in a cooling fluid reservoir 32 through the walls of the scroll volute passage 28. Noncondensibles collect in a noncondensibles pipe 31 disposed over the condensate pipe 29 across the scroll volute passage 28 and are discharged to the environment, regulated by suitable means.

Figure 11B:
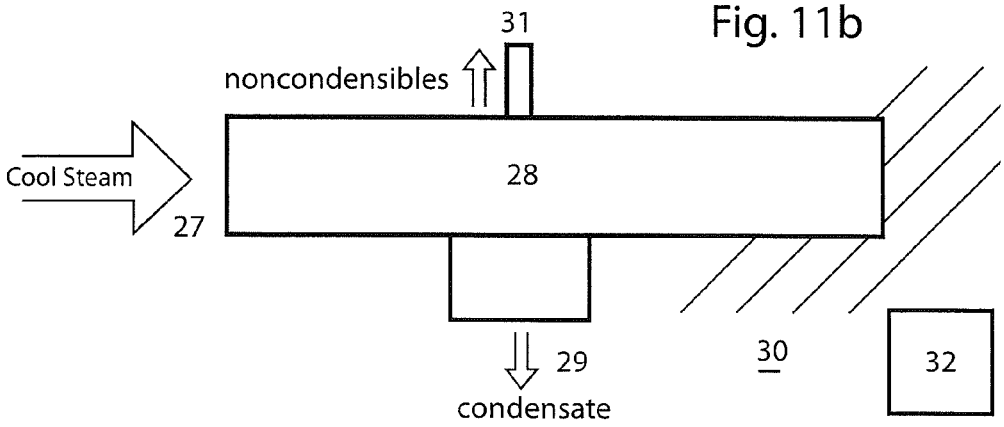

FIG. 11*b* shows a side view of the alternative condenser shown in FIG. 11*a*.

It should be apparent to those of ordinary skill in the art what particular applications of the novel ideas presented here may be made given the description of the embodiments. Therefore, it is not intended that the scope of the invention be limited to the specific embodiments described, which are merely illustrative of the present invention and not intended to have the effect of limiting the scope of the claims.

Instructed hindsight on the part of those of more than ordinary skill in the particular art of exhaust steam handling means and evaporative cooling should not be admitted as ex post facto evidence that the present invention was obvious or that they could easily have done it had they bothered, when the serious problem of power plant inefficiency and water waste has remained unsolved by so many for so long.

I claim:

1. An apparatus for generating electricity from wet exhaust steam, comprising:

opposed coaxial disks counter-rotatable about a common axis of rotation and spaced apart so as to define a radial workspace between them, the disks comprising radial runners configured such that the runners are impinged by the expanding wet exhaust steam and thereby cause the disks to counter-rotate;

an axial feed port at the center of one of the opposed coaxial disks, the axial feed port structured to communicate with the radial workspace to introduce wet steam into the radial workspace;

an axial exhaust port at the center of the opposite one of the opposed coaxial disks, the axial exhaust port structured to communicate with means for condensing steam axially extracted out of the radial workspace;

a baffle disposed between the axial feed port and the axial exhaust port; and a dynamo connected to a drive wheel, the drive wheel disposed at the periphery of the opposed coaxial disks and in contact with at least one of the opposed coaxial disks during counter-rotation of the opposed coaxial disks.

2. The apparatus of claim 1, wherein the radial runners curve oppositely as they extend radially outward from the common axis of rotation.

3. The apparatus of claim 1, wherein the axial exhaust port communicates with a mechanically forced low pressure sink.

4. The apparatus of claim 1, further comprising a shrouding wall disposed about the periphery of the disks.

5. A method of generating electricity by turbine exhaust steam, comprising the simultaneous steps of axially feeding turbine exhaust steam into a radial workspace defined by opposed coaxial radial turbines, thereby causing the radial turbines to counter-rotate about a common axis of rotation;

contacting the counter-rotating coaxial radial turbines at their periphery with a drive wheel connected to a generator; and axially extracting steam from the workspace to a condenser.

6. The method of claim 5, including recycling condensate emitted out of the periphery into a Rankine cycle.

* * * * *